United States Patent [19]

Flider

[11] Patent Number: 4,489,860

[45] Date of Patent: Dec. 25, 1984

[54] SAFETY CAN CONVERSION APPARATUS

[75] Inventor: Frank S. Flider, Mattoon, Ill.

[73] Assignee: Justrite Manufacturing Company, Mattoon, Ill.

[21] Appl. No.: 389,013

[22] Filed: Jun. 16, 1982

Related U.S. Application Data

[63] Continuation-in-part of Ser. No. 283,569, Jul. 15, 1981, abandoned.

[51] Int. Cl.[3] ..... B65D 47/08

[52] U.S. Cl. ..... 222/189; 222/505; 222/517

[58] Field of Search ..... 222/189, 472, 505, 517, 222/556

[56] References Cited

U.S. PATENT DOCUMENTS

| | | | |
|---|---|---|---|
| 1,954,983 | 4/1934 | Brown | 222/517 X |
| 2,365,695 | 12/1944 | Grice | 222/556 X |
| 3,469,747 | 9/1969 | Richmond | 222/189 X |
| 3,811,605 | 5/1974 | Flider | 222/472 |
| 3,844,456 | 10/1974 | Schiemann | 222/472 X |
| 4,273,265 | 6/1981 | Anderson | 222/189 |

*Primary Examiner*—F. J. Bartuska

*Attorney, Agent, or Firm*—Irwin C. Alter

[57] ABSTRACT

A safety dispensing conversion device for converting storage containers of inflammable fluids such as gasoline or the like, such as the well-known "jerry can", into a container with safety dispensing features. A pour spout, a flame arrester extending from the pour spout interiorly of the container, a safety cap in a normally closed relation to the pour spout, and a spring-biased operating handle and linkage arrangement mounted on the upper end of the container and connected to the safety cap to cause opening of the safety cap upon movement of the operating handle in an opening direction, and insuring closing of the safety cap due to the action of the biasing spring when the operating handle is released, in modular form, is integrated into such a container. The resulting container has the characteristics of a jerry can which permit stacking of the converted containers for efficiency in storage and transportation, with the converted container also having the safety dispensing features not found in prior art jerry cans. Further, the resulting container having the capability to automatically vent in response to excessive internal pressures, without movement of its control handle, so as to allow venting when in a stacked relation to other such containers.

3 Claims, 16 Drawing Figures

FIG.9
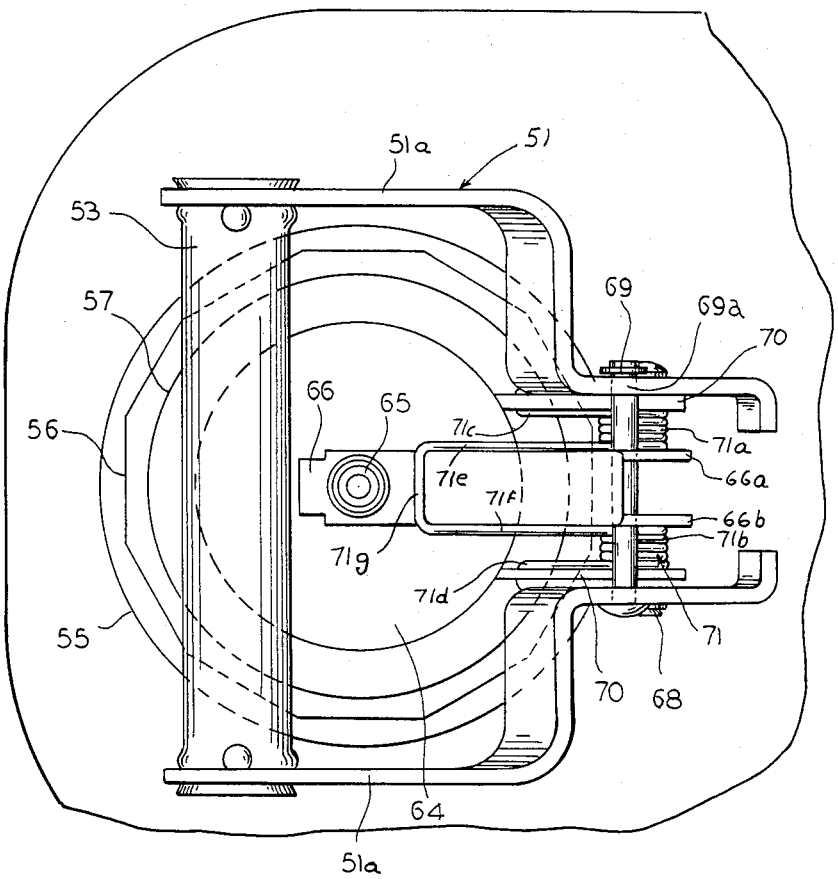
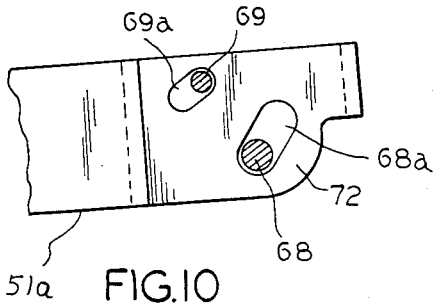
FIG.10
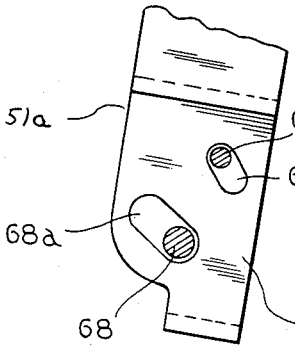
FIG.12
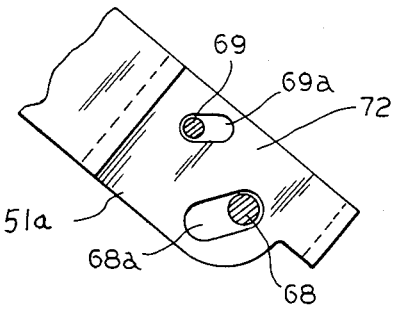
FIG.11
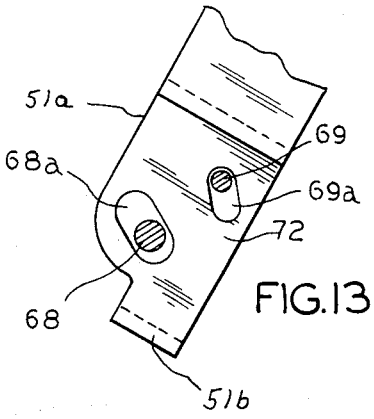
FIG.13

SAFETY CAN CONVERSION APPARATUS

BACKGROUND OF THE INVENTION

This is a Continuation-In-Part application from my earlier filed parent application Ser. No. 06/283,569 filed 7-15-81 now abandoned.

This invention relates to cans or containers for holding fluids and especially, although not exclusively, to containers for flammable fluids such as gasoline and the like, and more particularly to the so-called "jerry can".

Particularly, the invention relates to a container which has been converted into a "safety can" and to the adapter arrangement for effecting the conversion of the container into a safety can.

It is well-known in the prior art to use containers which are popularly known a "jerry cans" to store inflammable fluids such as gasoline. The containers may be made of steel or plastic and are so contoured and constructed that they may easily be stacked in a nested relation, one atop the other, for efficient space utilization during storage and transportation.

The following United States Patents show examples of prior art jerry cans:

- U.S. Pat. No. 3,746,200–issued to Frank S. Flider on July 17, 1973;
- U.S. Pat. No. 3,940,002–issued to Wolfram Schiemann on Feb. 24, 1976.

As best seen in the aforementioned Flider '200 patent, the prior art jerry can is provided with a simple cap member which is in screw-threaded engagement with threads inside the neck opening of the can. Similarly, the aforementioned Schiemann '002 patent shows a spout member having external threads which are adapted to engage internal threads of a screw-on type cap member, not shown.

The prior art jerry cans such as those shown in the aforementioned Flider and Schiemann patents are essentially storage receptacles for inflammable fluids, such as gasoline and the like.

On the other hand, it is also well-known in the prior art to provide so-called "safety cans" as exemplified by the following United States Patents:

- U.S. Pat. No. 1,312,822–issued to Pahr Anderson on Aug. 12, 1919;
- U.S. Pat. No. 2,365,695–issued to L. O. Grice on Dec. 26, 1944;
- U.S. Pat. No. 3,469,747–issued to Roy H. Richmond, Jr. on Sept. 30, 1969;
- U.S Pat. No. 3,727,807–issued to Frank S. Flider on Apr. 17, 1973;
- U.S. Pat. No. 3,729,122–issued to Frank S. Flider on Apr. 24, 1973;
- U.S. Pat. No. 3,794,235–issued to Frank S. Flider on Feb. 26, 1974;
- U.S. Pat. No. 3,811,605–issued to Frank S. Flider on May 21, 1974;
- U.S. Pat. No. 3,844,456–issued to Wolfram Schiemann on Oct. 29, 1974;
- U.S. Pat. No. 3,851,791–issued to Frank S. Flider on Dec. 3, 1974; and
- U.S. Pat. No. 4,273,265–issued to Bazeel B. Anderson on June 16, 1981.

Safety cans for inflammable fluids, such as those shown by the foregoing patents, are provided with an operating or control handle and linkage arrangement which automatically open a normally closed cap member when the container is tipped, while the handle is held, with the cap reclosing when the container is set down and the handle is released. And while separate flash arrester adapters exist which have been attachable by friction to fluid containers, none has been usable while simultaneously permitting stacking, together with secure affixation.

Safety cans also usually have a neck portion with a filter screen which strains the inflammable fluid entering and leaving the container and which also serves as a flame arrester or fire barrier.

However, safety cans of the prior art are generally not contoured or shaped in such a manner that they may be stacked in a nested relation, one atop the other, for efficiency in storage and transportation, for optimum space utilization, and for safely locking the fluid release members into a closed position.

Neither are the prior art safety cans capable of automatically venting in response to excessive interior pressures, when in stacked relation to other such cans.

Accordingly, it is an object of the present invention to convert a conventional jerry can into a safety can thereby providing a composite can which has the efficient space utilization features of the jerry can including "nested stacking" and the like and which also has the safety features of the safety can, including an operating handle and linkage which automatically opens a normally closed cap upon movement of the operating handle in an opening direction, with the cap automatically reclosing when the container is set down and the operating handle is released. Further, the safety cap pivots to vent the interior of the container, when the interior pressures overcome the spring biasing force, without moving the operating handle.

It is a further object of the invention to provide an adapter arrangement which permits conversion of a conventional jerry can into a safety can.

It is a further object of the invention to provide an adapter device which is removably mounted on a conventional jerry can.

A related object of the present invention is to provide an adjustable pour spout that can be aligned to face directly in the pour position.

A further feature of the invention is the sub-assembly of the fixtures which are mounted on the prior art jerry can to adapt it to receive the safety cap or cover, cover bracket and operating or control handle, and flame arrester, all of which cooperate to convert the prior art jerry can into a safety can.

Yet another feature of the invention is the downward inclination of the safety cap when in a closed position with respect to the pour spout, so as to limit the travel distance of spewing vapors and fuel in the event of fire.

In addition, an object of this invention is to provide a construction of safety cans wherein venting may occur when interior pressures rise to a certain level even when said cans are in stacked and nested relation.

Further objects and advantages of the invention will become apparent from the following description taken in conjunction with the accompanying drawings.

SUMMARY OF THE INVENTION

This invention comprises a safety dispensing container for an inflammable fluid, such as gasoline, having a hollow interior. An opening is provided at the upper surface of the container which allows pouring of the contents. A downwardly angled pour spout is secured within the opening. At the outer edge of the pour spout, a safety cap is adapted to seat and thereby close off the spout. Linkage connects the safety cap to an operating handle. Consequently, pivotal movement of the operating handle opens the safety cap, which is biased by a spring towards the closed position.

Stacking of two or more of these types of containers is achieved through the use of a recessed bottom portion adapted to receive the flat horizontal top portion of the container below it.

In the event of excessive pressures within the container, automatic venting takes place. The safety cap is capable of pivoting in response to excessive interior pressures without moving the operating handle. Likewise, a "low profile" operating handle apparatus can be employed wherein the flat plate-like handle provides additional clearance between the handle and the bottom of the container stacked above it. In this manner, the safety caps are allowed to pivot and thereby vent the interiors of the containers even when they are in a stacked arrangement. The outer portion of the pour spout of this invention is offset angularly downward with respect to the remainder of the spout so as to further restrict the distance travelled of spewing vapors or liquids.

BRIEF DESCRIPTION OF THE DRAWINGS

FIG. 9 is a top plan view of the converted jerry can and adapter unit of FIG. 8;

FIG. 10 is a side elevational view of the operating handle of FIGS. 8 and 9 in its "downy" position in which the cover of the converted jerry can is closed;

FIG. 11 is a side elevational view of the operating handle of FIG. 10 at its initial position for opening the cover, but in which the safety cap or cover is still closed;

FIG. 12 is a side elevational view of the operating handle in standard pouring position with the handle engaging the stop point;

FIG. 13 is a side elevational view of the operating handle pulled beyond the normal stop point for replacement of the filter screen (flame arrester) or for filling the container.

DETAILED DESCRIPTION OF THE DRAWINGS

Figure 1:
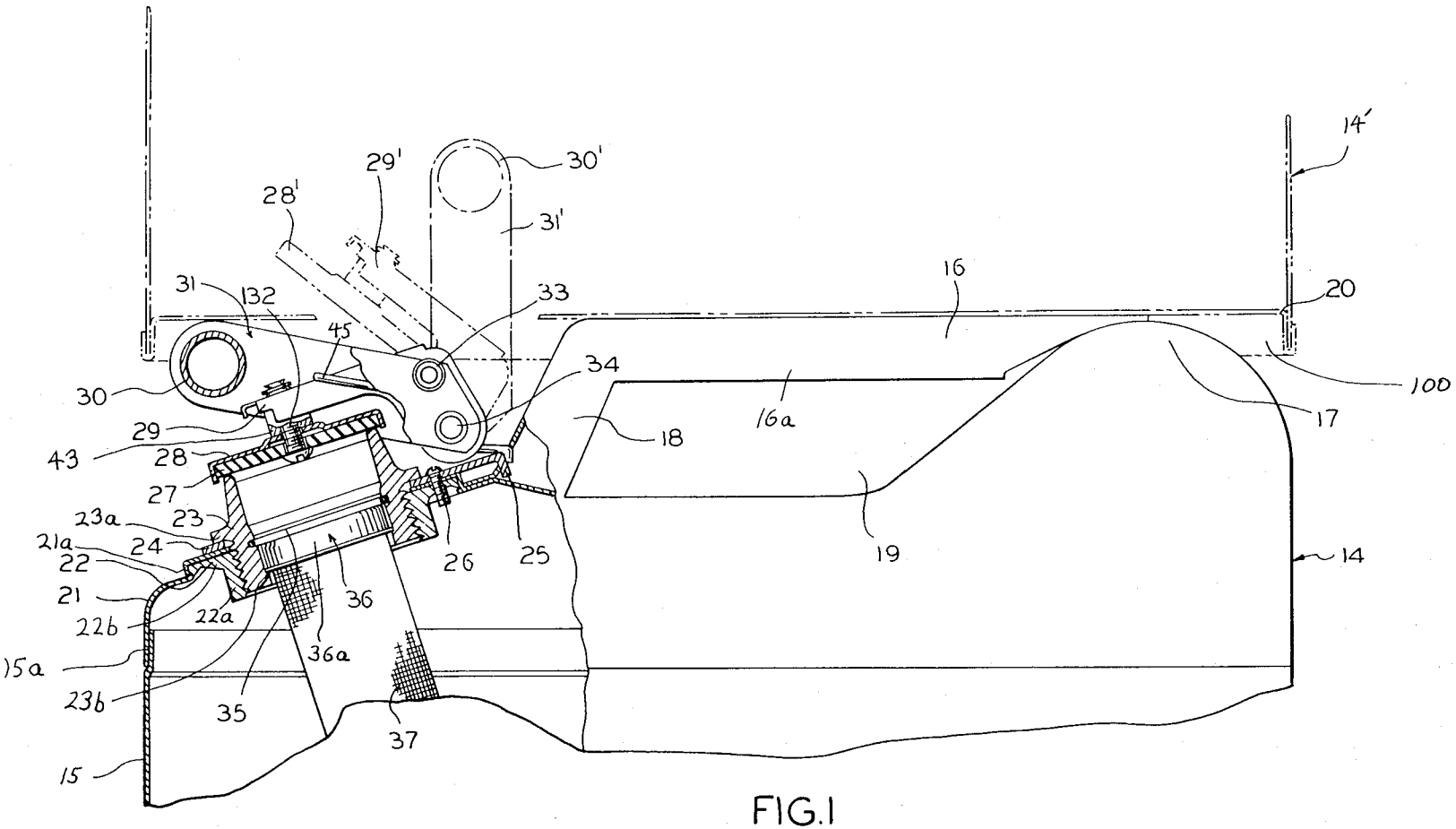
FIG. 1 is a side elevational view showing a standard jerry can converted to a safety container using the adapter arrangement of the invention.

Referring now to FIGS. 1 through 7, inclusive of the drawings, and more particularly to FIG. 1, there is shown a receptacle or container generally indicated at 14 for inflammable fluids, such as gasoline or the like, which may be generally similar in shape to the jerry can shown in the aforementioned Flider '200 patent. Container 14 includes an upper body portion 21 which is connected to lower body portion 15 and an upper body portion 21 which is connected to lower body portion 15 by a lap joint **15*a***. The jerry cans of the embodiments of the invention shown and described in the present application may be made of a metal, such as steel, may be made of blow-molded plastic as in the case of the jerry can of the aforementioned Flider '200 patent, or may be made of injection-molded plastic as in the case of the aforementioned Schiemann '002 patent. The principles of the present invention are applicable regardless of the material of which the container is made.

The left-hand portion of upper body portion 21 of the container as seen in FIG. 1 is tapered, and the material of upper body portion 21 in the tapered region is formed to define a radially inwardly turned external flange **21*a* which bounds an opening through which pour spout 23 extends. The spout angle of said spout 23 in this embodiment being approximately 70 degrees from the horizontal. In this embodiment, the safety cap 28 is approximately perpendicular to the longitudinal axis of pour spout 23 when seated upon the pour spout 23** in the closed position. Therefore, though this combination of spout angle and angle of safety cap with respect to said spout is illustrated in the embodiment, other combinations that achieve the desired results should be considered as being within the scope of this invention.

External flange **21*a* overlies and is reinforced by a neck member 22 having a cylindrical body portion 22*a* and a radially outwardly extending flange portion 22*b*. Neck member 22 is formed of material having a substantially greater thickness tnan the material of which the body of container 14 is made. Neck member 22 is a permanent part of the container. The right-hand portion of the upper end of container 14 as viewed in FIG. 1 is contoured to define a hump 17. Carrying handle 16 is provided in the same general manner as shown in the aforementioned Flider '200 and Schiemann '002 patents. The upper surface of handle 16 lies in a normally horizontal plane. Handle 16 includes a normally horizontal portion 16*a* which is connected at its right-hand end relative to the view of FIG. 1 to hump 17 of the container. Handle 16 also includes at its left-hand end, as viewed in FIG. 1, a downwardly inclined portion 18 which is suitably connected to an intermediate portion of the top surface of upper body portion 21 of the container. An open space 19 is defined between the upper surface of upper body portion 21 and the under surface of horizontal portion 16*a* of the handle. The user of the container may insert his fingers through space 19 when handle 16** is being grasped.

Figure 3:
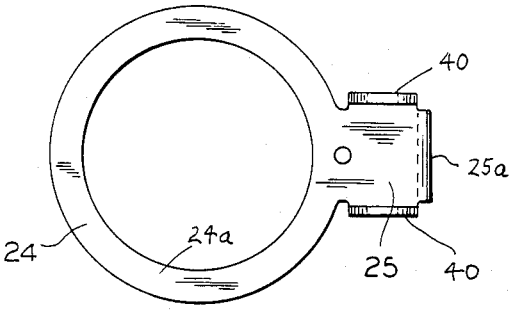
FIG. 3 is a top plan view of the pour spout flange of the adapter unit of FIG. 1.
Figure 4:
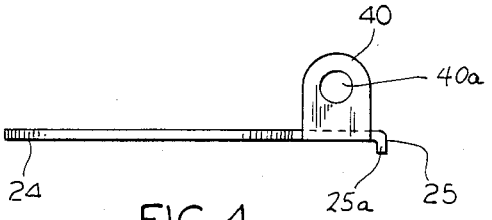
FIG. 4 is a side elevational view of the pour spout flange of FIG. 3.
Figure 5:
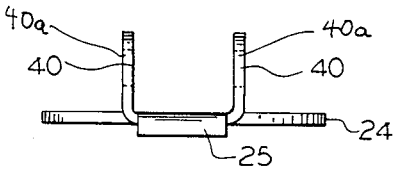
FIG. 5 is an end view of the pour spout flange looking in from the right-hand end of FIG. 4.

A pour spout flange 24, the details of which are best shown in FIGS. 3, 4 and 5, and which will be described in more detail hereinafter, is positioned in overlying relation to the radial outer surface of external flange **21*a*** on upper body portion 21 and in circumscribing relation to the opening defined by external flange 21*a* and neck 22. Pour spout flange 24 is secured in position by a self-tapping screw 26 which passes through pour spout flange 24, through external flange 21*a* of upper body portion 21, and through the hole in flange portion 22*b* of neck member 22 to which the container vent tube had previously been connected, as shown for example, in the aforementioned Flider '200 patent.

A hollow pour spout generally indicated at 23 is provided which includes a lower externally screw-threaded portion which engages with the internal threads on neck 22. Pour spout 23 is provided intermediate its height with a radially outwardly extending integral external flange 23*a* which seats on the outer surface of pour spout flange 24 when pour spout 23 is in complete screw-threaded engagement with neck member 22.

In order to prevent fluid leakage at the interface between the threads of neck 22 on upper body portion 21 and the inner threaded end of pour spout 23, the mating surfaces of neck 22 and of pour spout 23 may be coated with a suitable epoxy resin which forms a fluid-tight seal between these members.

A flame arrester sub-assembly generally indicated at 36 is suspended from the interior of pour spout 23 and projects into the interior of the upper end of container 14. Flame arrester sub-assembly 26 includes a gathering ring 36*a* from which is suspended a filter screen 37 which strains the fluid entering and leaving the converted container and also serves as a fire barrier. Gathering ring 36*a* of the flame arrester sub-assembly seats on a shoulder 23*b* formed on the inner periphery of the lower end of pour spout 23. A retaining ring 35 is received in a peripheral groove on the inner periphery of pour spout 23 and serves to prevent unintended outward movement of flame arrester sub-assembly 36–37.

As best seen in FIGS. 3, 4 and 5, pour spout flange 24 includes an annular-shaped portion 24*a* adapted to circumscribe the outer periphery of pour spout 23. Pour spout flange 24 also includes a radially outwardly projecting tongue portion 25 which extends beyond the outer circumference of annular portion 24*a* and includes a downwardly bent portion 25*a*. A pair of leg members indicated at 40 extend perpendicularly to the plane of tongue portion 25 of pour spout flange 24. Each of the upstanding leg members 40 includes a centrally located aperture or passage 40*a* therethrough. The upwardly extending legs 40 and the apertures 40*a* therein serve as a pivotal mounting means for operating handle 31 which will now be described.

Figure 6:
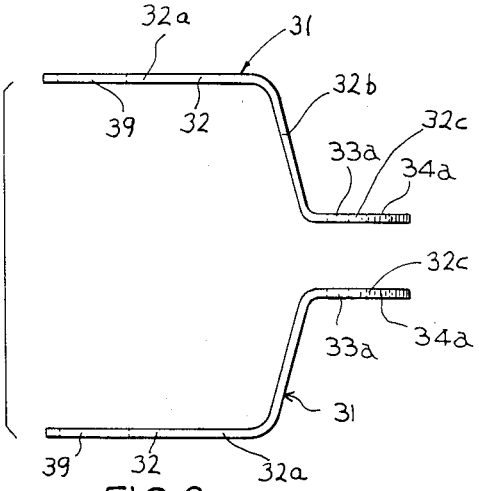
FIG. 6 is a top plan view of the two handle straps of the adapter device of FIG. 1.
Figure 7:
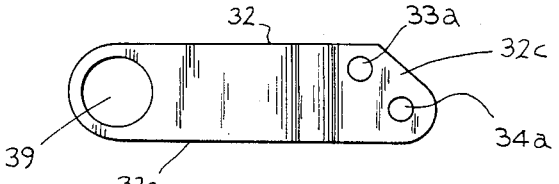
FIG. 7 is a side elevational view of one of the handle straps of FIG. 6.

As best seen in FIGS. 6 and 7, a pivotally mounted operating or control handle generally indicated at 31 is provided to control the opening of the safety cap to be hereinafter described. Handle 31 includes a pair of handle straps, indicated at 32. Handle straps 32 include a laterally outer straight portion 32*a*, a lateral inwardly extending tapered strap portion 32*b*, and laterally inner straight strap portion 32*c* which extend rearward from the inner end of the corresponding tapered strap portion 32*b*. The straight portions 32*a* of the two handle straps 32 are provided with aligned apertures, indicated at 39, which are adapted to receive the opposite ends of tne crossbar portion 30 of handle member 31.

Also, straight portions 32*c* of the respective handle straps 32 are provided with a forward aperture 33*a* and a rearward aperture 34*a* as best seen in FIGS. 6 and 7. Handle 31 is pivotally connected to leg members 40 of pour spout flange 24 by means of a pivot pin 34 in FIG. 1, which extends through tne aligned apertures 40*a* of leg members 40 of pour spout flange 24. Pivot pin 34 may be a rivet.

The safety cap 28 which normally seats on the outer end of pour spout 23 includes a gasket 27 which seals against the upper or outer end of pour spout 23 when cap 28 is in the closed position shown in FIG. 1.

The movement of cap 28 to an open position is controlled by operating handle 31 and a linkage or cover bracket 29 which will now be described.

Screw 132 secures a pin bracket 43 to the upper end of safety cap 28, and an L-shaped cover bracket 29 is loosely connected to pin bracket 43 and, thus, to safety cap 28. The L-shaped cover bracket 29 is also pivotally connected about the axis of pin 34 to leg members 40 of pour spout flange 24 whereby cover bracket 29 moves pivotally about pivot pin 34 along with handle 31. Thus, handle 31 and cover bracket 29 are both mounted for pivotal movement about the axis of pin 34. Handle 31 is connected to cover bracket 29 by means of pin 33 which passes through apertures 33*a* of handle strap portions 32*c*, with pin 33 also passing through a corresponding passage or aperture in cover bracket 29. A spring 45 bears against the upper surface of cover bracket 29, as best seen in FIG. 1, with the end of spring 45 bearing against the downwardly turned lip portion 25*a* of pour spout flange 24. Spring 45 constantly exerts a force against cover bracket 29 which urges cap 28 into a closed position. Spring 45 of FIG. 1 may be similar to spring 71 shown in FIG. 9.

In using the converted container 14 of FIGS. 1 through 7, when it is desired to pour the inflammable fluid, such as gasoline and the like, handle assembly 31 is swung in a clockwise direction relative to FIG. 1 about the axis of pin 34 to approach the phantom line position of FIG. 1. Due to the interconnection provided between handle assembly 31 and cover bracket 29 by pin 33, movement in a clockwise direction of handle assembly 31 causes clockwise movement of cover bracket 29 about the pivotal axis 34, without any lost motion, to cause cover bracket 29 and cap member 28 to move toward the dotted line phantom positions indicated 28'–29', the movement of cover bracket 29 being against the biasing force of spring 45. When handle 31 is released with safety cap 28 in an open position, spring 45 forces cap 28 back to a closed position and also moves handle assembly 31 back to the closed position. If an excessive pressure occurs within container 14, cap 28 opens against the force of spring 45 to vent container 14. Cap 28 is reclosed by the force of spring 45 when the pressure inside container 14 lowers to a predetermined acceptable value.

It should be noted that the sub-assembly which is used to modify the prior art jerry can to convert it into a safety can may be permanently affixed or removed and transferred to a different container if the original container becomes unusable. Thus, with respect to the embodiment shown in FIGS. 1 through 7 inclusive, the sub-assembly comprising pour spout 23 and attached flame arrester sub-assembly 36, pour spout flange 24, safety cap 28 and attached pin bracket 43, cover bracket 29, operating handle 31, and spring 45 may all be removed by unscrewing screw 26 from engagement with neck member 22 and with flange 21*a* of upper body portion 21 of container 14. Pour spout 23 may then be unscrewed from neck 22 at the upper end of container 14 to permit removal of the entire adapter sub-assembly from container 14. Neck 22 remains as a permanent part of container 14.

Figure 2:
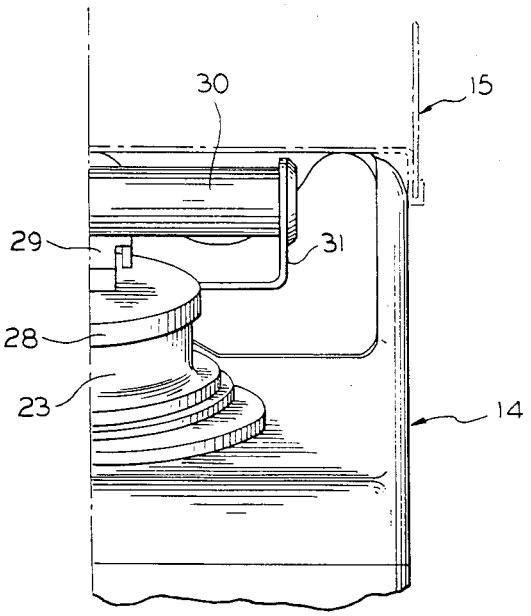
FIG. 2 is an end view of the converted container looking in from the left-hand end of FIG. 1.
Figure 8:
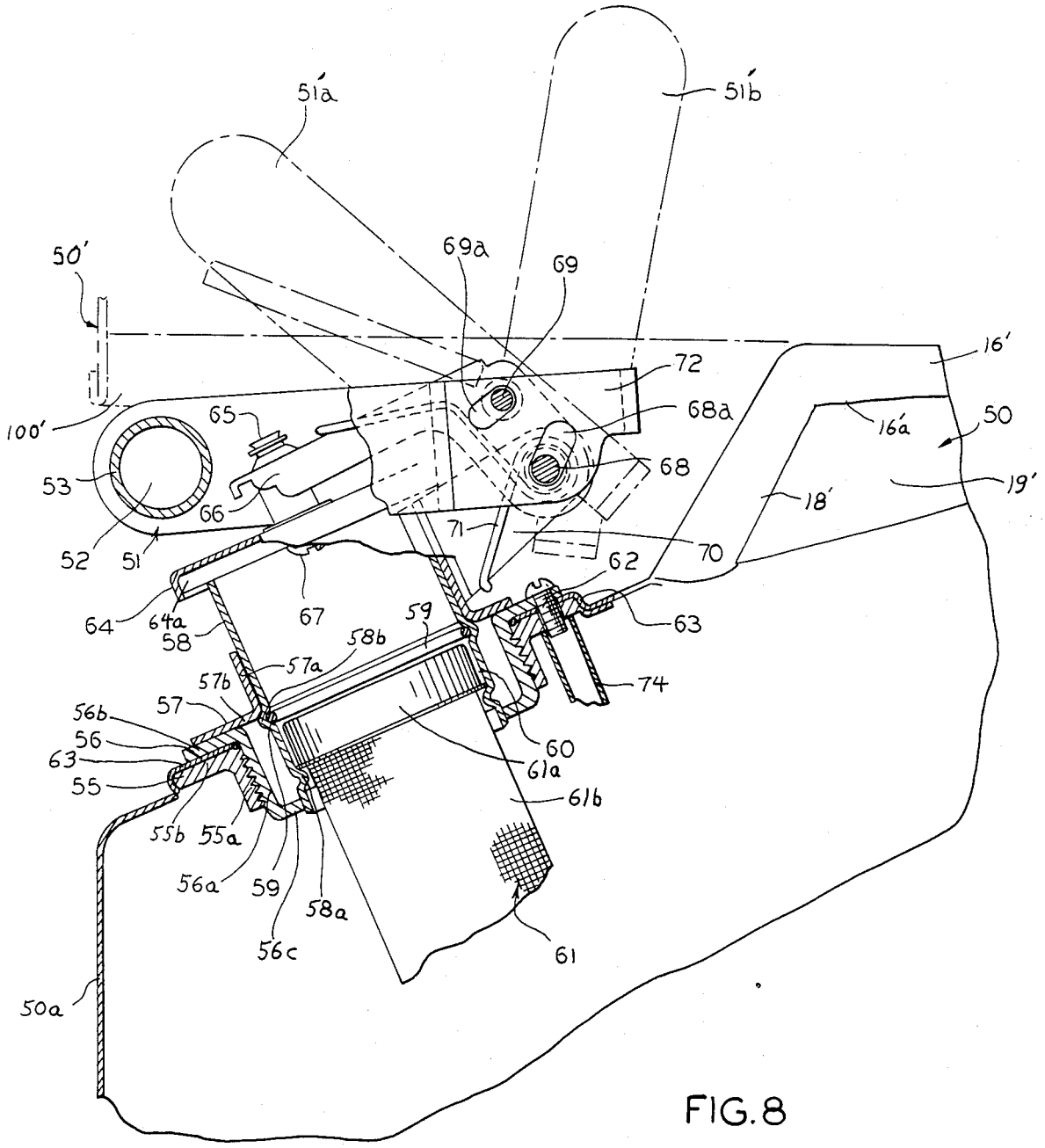
FIG. 8 is a sectional view of a modified adapter arrangement for converting a conventional jerry can into a safety container.

Referring now to FIGS. 8 through 13 inclusive, there is shown a fragmentary view of a jerry can generally indicated at 50, which may be similar to the jerry can shown in the aforementioned Flider '200 patent and similar to container 14 shown in FIGS. 1 and 2 of the present application. The jerry can 50 of the embodiment of FIG. 8 includes a body 50*a* and a carrying handle as shown in the aforementioned Flider '200 patent, although only a fragmentary portion of this handle indicated at 16' is shown in FIG. 8. Handle 16' of FIG. 8 includes a horizontal portion 16'*a* and an inclined portion 18' which are respectively similar to the handle portions 16'*a* and 18 of the embodiment of FIG. 1.

At the left-hand side of the upper end of jerry can 50 as viewed in FIG. 8, the material of the jerry can is formed to define a radially inwardly turned external flange 63. External flange 63 overlies an internal neck member 55 formed of material having a greater thickness than that of jerry can body 50*a*. Neck member 55 includes a hollow cylindrical body portion 55*a* and a flange portion 55*b*. Body portion 55*a* is internally threaded. A collar member generally indicated at 56 is provided and includes a generally cylindrical-shaped body portion 56*a*, a radially outwardly extending flange 56*b* at the upper end of collar member 56, and a radially inwardly extending flange 56*c* at the lower end of collar member 56. Collar 56 is adapted to threadedly engage neck member 55 by means of external screw threads on body portion 56*a* which threadedly engage internal threads on body portion 55*a*. The mating threaded surfaces of neck member 55 and collar 56 are coated with a suitable epoxy resin to provide a fluid-tight seal between neck member 55 and collar 56.

Collar member 56 is secured in position and against any rotation relative to jerry can body 50*a* by means of a screw member 62 which extends through a passage in flange 56*b* of collar member 56, through flange 63 of jerry can body 50*a*, and through flange portion 55*b* of neck member 55. It will be noted that the screw 62 extends into the upper end of the internal vent tube 74 which is part of the structure of the jerry can 50 which is being converted, the vent tube 74 serving no function in this embodiment and being plugged permanently.

A sleeve member generally indicated at 57 is provided and includes a cylindrical sleeve portion 57*a* and a radially outwardly extending flange portion 57*b*. Flange portion 57*b* rests on and, in the final assembly, is secured by means of spot welds to the upper surface of flange portion 56*b* of collar 56.

Sleeve portion 57*a* of sleeve member 57 and the radially inwardly extending flange portion 56*c* of collar 56 cooperate to secure in position, a pour spout generally indicated at 58. Pour spout 58 is a generally hollow cylindrical member open at both of its axially opposite ends and secured by spot welds to the inner periphery of sleeve portion 57*a*.

Pour spout 58 is angularly situated at a spout angle of approximately 70 degrees with respect to the common horizontal plane.

The upper or axially outer end of pour spout 58 is open and serves as a seat for the safety cap member generally indicated at 64. The gasket 64*a* sits on the upper edge of pour spout 58.

The lower or axially inner end of pour spout 58 is engaged and stabilized by the radially inner edge of flange 56*c*, with flange 56*c* being soldered to the outer periphery of the axially inner end of pour spout 58.

The axially inner portion of pour spout 58 also cooperates to support and retain a flame arrester sub-assembly generally indicated at 61, which is similar to flame arrester sub-assembly 36 shown in the embodiment of FIGS. 1 through 7 and includes a gathering ring 61*a* from which is suspended filter screen 61*b* which strains the fluid entering and leaving the converted jerry can 50. Gathering ring 61*a* of the flame arrester sub-assembly seats on a shoulder defined by a radially inwardly turned bead 58*a* on the axially inner portion of pour spout 58. A second bead 58*b* is provided in pour spout 58 at a level above gathering ring 61*a* of flame arrester subassembly 61, bead 58*b* opening inwardly and defining a groove which receives a lock ring 59 which serves as an abutment to limit axially outer movement of flame arrester sub-assembly 61.

A handle assembly generally indicated at 51 is provided and includes a pair of handle straps, each indicated at 51*a*, which are pivotally mounted on a pair of spaced bracket arms 70 which are rigidly secured to the outer surface of pour spout 58. The two handle straps 51*a* are connected to each other by crossbar 53.

Each of the opposite handle straps 51*a* is provided at the lower portion thereof with an elongated slot or opening 68*a* which receives a pivot pin 68 passing through the laterally spaced stationary bracket arms 70. Pin 68 serves as a pivotal support for handle assembly 51. An L-shaped cover bracket 66 is loosely connected to a pin bracket 65 which in turn is secured to safety cap 64 by means of screw 67. Cover bracket 66 is pivotally mounted about the axis of pin 68 for pivotal movement with respect to mounting brackets 70. Thus, handle assembly 51 and cover bracket 66 are both mounted for pivotal movement about a common axis, namely, the axis of pin 68.

Safety cover 64 is constantly biased toward closing position by a coil spring generally indicated at 71. Coil spring 71 includes two coil sections 71*a* and 71*b*, respectively, which are wound around pivot pin 68 about which handle 51 and also cover bracket 66 are pivotally mounted. The left-hand end of coil 71 (as viewed from the left end of FIG. 9 and indicated at 71*c*) is anchored beneath the left-hand stationary bracket arm 70. Similarly, the right-hand end of coil spring 71 as viewed from the left-hand end of FIG. 9, and indicated at 71*d*, is anchored beneath the right-hand stationery bracket arm 70. One end of spring coil section 71*a*, indicated at 71*e*, is brought out and connected to one end of coil spring section 71*b*, as indicated at 71*f*, with the ends of the two coil springs 71*a* and 71*b* being connected by the portion 71*g*. The connected spring portions 71*e*, 71*f* and 71*g* together define a U-shaped spring member which forms part of the spring sections 71*a* and 71*b* and which bears against the outer surface of L-shaped cover bracket member 66 to constantly urge safety cap 64 toward a closed position.

A pin member 69 extends through the trailing or right-hand end portions 66*a* and 66*b* of L-shaped cover bracket 66 as shown in FIG. 9, the opposite ends of pin 69 being received in oppositely disposed elongated slots 69*a* of the oppositely disposed handle straps 51*a*. Pin 69 is a lift pin in which cover bracket 66 is operatively connected to operating handle 51 to effectuate opening movement of L-shaped cover bracket 66 and the attached safety cover or cap 64 when operating handle 51 is moved to an open position as will be described.

When operating handle 51 is in its downward position and safety cap 64 is closed, as seen in full line in FIG. 8, cover bracket lift pin 69 is proximate the mid-point of slot 69*a*. This configuration allows for both pulling said handle 51 upward for an interval without moving said safety cap 64 and likewise for said safety cap 64 moving upwards to vent the contents of can 50 without engaging and moving said handle 51. Pivot pin 68, about which handle 51 and L-shaped cover bracket 66 are both pivotally movable, is in the lower end of its corresponding slot 68*a* when said handle is in said downward position. (See also in FIG. 10).

When it is desired to open safety cap or cover 64, handle 51 is swung in a clockwise direction as viewed in FIGS. 8 and 9, causing slot 68*a* in handle 51 to move in a clockwise direction from the position of FIG. 10 to the position of FIG. 11, whereby causing pivot pin 68 to lie in the righthand end of slot 68*a* as viewed in FIG. 11 and causing cover bracket lift pin 69 to lie at the left-hand end of slot 69*a* as viewed in FIG. 11. In the view of FIG. 11, safety cap 64 is still closed, but the various cooperating members, including handle 51 and cover lift bracket 66 are just at the starting point to begin opening cap 64.

The view of FIG. 12 shows the position of handle 51 when it has been swung clockwise from the FIG. 11 position to the standard pouring position (shown in phantom line at 51*b* in FIG. 8), in which the right-hand end of handle 51 strikes up against the underneath edge of laterally spaced stationary brackets 70 which define a stop point for opening movement of handle 51 corresponding to the pouring position of safety cover 64 with respect to pour spout 58. During the movement of handle 51 from the FIG. 11 position to the FIG. 12 position in which safety cap 64 is open for pouring, the movement of handle 51 is transmitted to cover bracket 66 and thus, to safety cap 64 by the engagement of cover bracket lift pin 69 with the bounding edge of slot 69*a* of handle 51.

FIG. 13 represents the position of operating handle 51 and the cooperating pins 68, 69 and slots 68*a* and 69*a* when handle 61 has been pulled beyond the normal stop point as might be required, for example, for replacement of filter screen 61 or for filling the container if necessary. When handle 51 is pulled beyond the stop point as shown in FIG. 13, dog 51*b* on the outer end of each handle strap 51*a* slides along the edge of the corresponding bracket arm 70 to cause handle strap 51*a* and slot 68*a* thereof to shift relative to pivot pin 68 as will be seen by comparing FIG. 13 with FIG. 12. Pivot pin 68 remains in the same position relative to its mounting on stationary bracket 70, but moves relatively upwardly in the slot 68*a* in which pin 68 is received, as will be seen by a comparison of FIGS. 12 and 13, although lift pin 69 remains at the same relative position in slot 69*a* in both FIGS. 12 and 13. The movement of slot 68*a* relative to pivot pin 68, by which pin 68 moves upwardly in slot 68*a* as seen in FIG. 13 upon movement of handle 51 beyond the stop point avoids any additional stress or strain on the operating mechanism.

The aforementioned cooperating pins 678 and 69 and slots 68*a* and 69*a* provide a lost-motion arrangement enabling venting of the interior of container 50, through rotation of safety cap 64 and bracket 66 about pin 68 without engagement and rotation of handle 51. Hence, venting can take place in response to excessive internal pressures even when said containers are in a stacked arrangement.

As can best be seen in FIG. 1, the prior art jerry can having attached thereto the cooperating safety cap and handle mechanism in accordance with the present invention, and which converts the prior art jerry can into a safety can, can be stacked in the same manner as is possible with prior art jerry cans which do not have mounted thereon the adapter device of the invention. Thus, as seen in FIG. 1, when handle assembly 31, cover bracket 29, and safety cap 28 are in the closed position shown in full line in FIG. 1, another converted container 14', which is similar in all respects to the converted container 14 hereinbefore described and shown in the drawings, can be stacked on top of the lower container 14. Thus, the container 14' as shown in phantom in FIG. 1, like all of the embodiments herein described, has a bottom wall indicated at 100 which is recessed inwardly from the bottom thereof and which is adapted to rest in a nested relation on the normally horizontal flat upper surface of carrying handle or handle 16 of lower container 14.

Operating handles 31 (FIG. 1), 51 (FIG. 9), 123 (FIG. 14) and 223 (FIG. 15) are so dimensioned as to length and width and also with respect to the angle of the handle assembly relative to the horizontal that the handle assembly remains within the confines of the perimeter of containers 14 (FIGS. 1 through 7, inclusive), 50 (FIGS. 8 through 13, inclusive), 101 (FIG. 14) or 201 (FIGS. 15 and 16) when in the closed position thereby facilitating the stacking of the containers.

As previously mentioned, containers 14 (FIG. 1), 50 (FIG. 8), 101 (FIG. 14) or 201 (FIGS. 15 and 16) may have a shape generally similar to that of the jerry can shown in the aforementioned Flider '200 patent and includes front and back walls, with each of said walls having a major surface area of the other said walls. The container body also includes laterally opposite end walls, each of which has a major surface area thereof extending parallel to a major surface area of the other end wall. The major surface areas of the end walls extend substantially perpendicular to the major surface area of the front and back walls to define a container body having a substantially rectangular perimeter, although the corners thereof may be rounded as shown in the aforementioned Flider '200 patent. The construction of the converted containers as just described, plus the arrangement of the handle assembly on the upper end of each container as previously described, permits a plurality of converted containers to be placed side by side, front to back, and top to bottom for efficient space utilization for storage and/or transportation.

Figure 14:
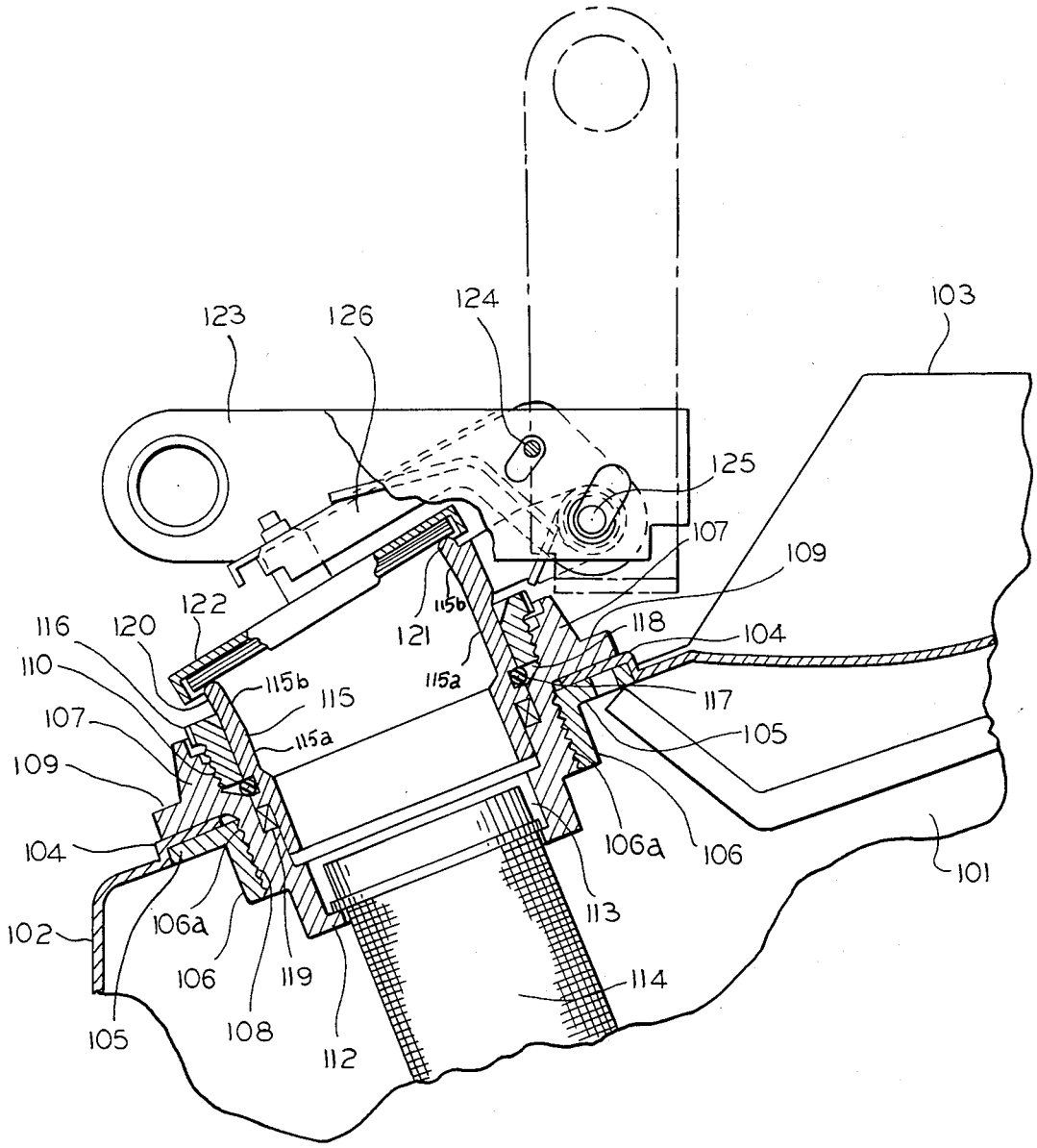
FIG. 14 is a sectional view of a modified adapter arrangement having an angled pour spout for limiting the travel of spewing vapors and fuel.

As previously described in connection with the container adapter sub-assembly of the embodiment of FIGS. 1 through 7 inclusive, and the container adapter sub-assembly of the embodiment of FIGS. 8 through 13, inclusive, may also be detached from container 50 and transferred to a different container if the original container 50 becomes unusable for some reason or may be permanently affixed. The sub-assembly comprising pour spout 58, sleeve member 57 which is attached to pour spout 58 and collar 56, collar 56 which is in screw-threaded engagement with neck 55, flame arrester sub-assembly 61, safety cap 64, pin bracket 65 attached to safety cap 64, cover bracket 66, handle 51, and spring 71, may all be removed together from the upper end of container 30. The adapter sub-assembly just described may be removed from container 50 by removing screw 62 from its engagement with neck 55 and with flange 63 of container 50*a*, and by then unscrewing collar 56 from its screw-threaded engagement with neck member 55 on container 50a. Neck member 55 remains as a permanent part of container 50a. In FIG. 14, another preferred embodiment of an adapter arrangement shows a fragmentary view of a jerry can generally indicated at 101. The fragmentary view of jerry can 101 shown in FIG. 14 includes jerry can body 102 and the top of carrying handle 103.

The jerry can body 102 is formed into an inwardly turned external flange 104 at the upper portion of jerry can 101 as viewed in FIG. 14. External flange 104 overlies an internal neck member 105. Neck member 105 includes a hollow cylindrical body portion 106 with internal threads 106a. A main collar member is generally indicated at 107, and includes lower external threaded portion 108, horizontal flanged portion 109 and upper internal threads 110. Main collar member 107 is secured in position by engaging lower external threads 108 with internal threads 106a of hollow body portion 106.

Main collar member 107 is inwardly flanged at 112 defining a cylindrical void 113, in which flame arrester assembly 114 is seated. Pour spout 115 serves as an abutment to limit axially outward movement of flame arrester 114.

Pour spout 115 is operably disposed within main collar member 107. Swival ring 116 is threadedly received by upper internal threads 110 of main collar member 107 and maintains retainer 117 within notch 118 in pour spout 115. Pour spout 115 can freely rotate 360 degrees and, thus, can be aligned to face directly into the pour position. Seal 119 prevents fluids within jerry can 101 from escaping into the atmosphere when pour spout 115 is closed.

Pour spout 115 extends angularly above swival ring 116. In this embodiment, the pour spout front portion 120 is vertically shorter than pour spout rear portion 121. Consequently, pour spout outer edge 115c is offset angularly downward with respect to pour spout inner end 112. The pour spout 115 is shown as having a spout angle of approximately 70 degrees with respect to a common horizontal plane. The downwardly angled edge 115c of pour spout 115 effectively limits spewing vapors and fuel from escaping from jerry can 101. The operative features of safety cap member 122, handle assembly 123, pin member 124, pivot pin 125 and cover bracket 126 remain unchanged from 64, 51, 69, 68 and 66 respectively, shown in FIG. 8.

As described in connection with the embodiment of FIG. 8, a lost motion mechanism is provided by pin member 124, pivot pin 125 and cover bracket 126 so as to allow for venting of the interior of container 150 in the event of excessive pressures therein by movement of safety cap 122 without movement of handle 123. This is required when containers such as 150 are in stackable relation since upward travel of handle 123 would be restricted due to the lack of clearance between handle 123 and the lower edge of container 150' (shown in FIG. 14) stacked above it. Furthermore, pin 124 is positioned midway between the ends of slot 124a when handle 123 is in the down position 80 as to allow upward movement of handle 123 without moving safety cap 122 from pour spout edge 115c.

This embodiment further shows safety cap member 122 inclined and seated at a downward angle of approximately 100 degrees with respect to the longitudinal axis of pour spout 115 when in the closed position, which as previously described is a result of front portion 120 of pour spout 115 being vertically shorter than pour spout rear portion 121. As shown in FIG. 14, the downward angle of approximately 100 degrees of the safety cap member 122 with respect to the longitudinal axis of pour spout 115 is accomplished by either offsetting outer pour spout portion 115b with respect to inner pour spout portion 115a or, angularly slicing the outer pour spout portion 115b of pour spout 115 so that pour spout front portion 120 is sufficiently below pour spout rear portion 121 as to cause safety cap 122 to rest upon pour spout 115 at the desired angle, when in the closed position. While this particular configuration has been shown to achieve the desired results of limiting the distance of travel of spewing vapors and fuel, such other configurations of spout angle and safety cap member angle with respect to the pour spout, that achieve the above-mentioned results should also be considered as being within the scope of the invention.

Figure 15:
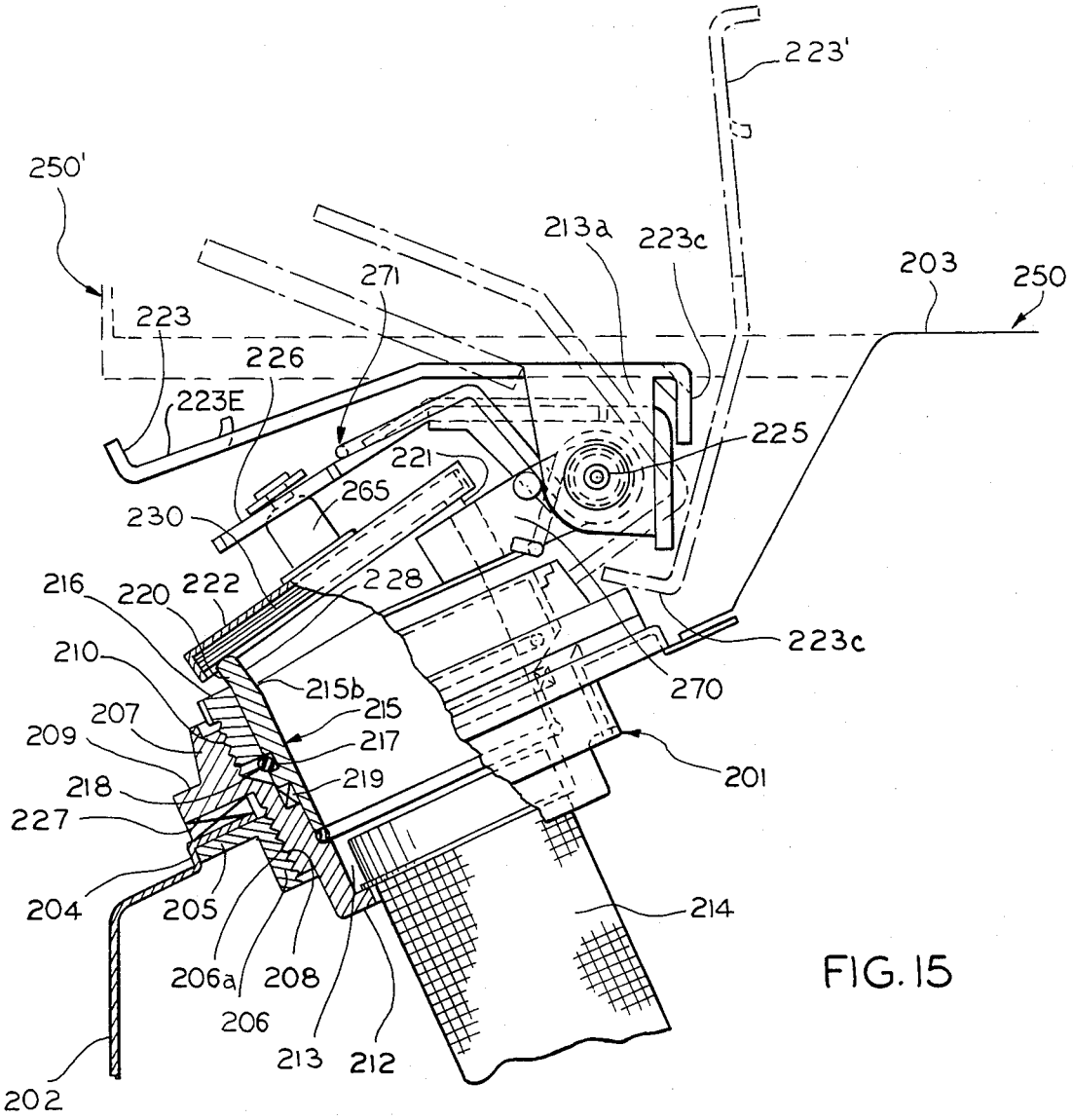
FIG. 15 is a sectional side view of another embodiment of the modified adapter arrangement having an angled pour spout for limiting the travel distance of spewing vapors and fuel and a low-profile handle configuration to allow venting even when in stacked relation.

Another preferred embodiment of an adapter arrangement is shown in FIG. 15. The fragmentary view of jerry can 201 shown in FIG. 15 includes jerry can body 202 and the top of carrying handle 203.

The jerry can body 202 is formed into an inwardly turned external flange 204 at the upper portion of jerry can 201 as viewed in FIG. 15. External flange 204 overlies internal neck member 205. Neck member 205 includes a hollow cylindrical body portion 206 with internal threading 206a. Main collar member 207 is generally shown in FIG. 15, including lower external threaded portion 208, horizontal flanged portion 209 and upper internal threads 210. Main collar member 207 is securely positioned by engagement of lower external threads 208 with internal threading 206a of body portion 206. Gasket 227 is interposed between collar member and external flange 204 so as to provide a sealed arrangement therebetween. Furthermore, a sealant is applied to lower external threads 208 of collar member 207 and internal threading 206a of body portion 206, so as to provide an air and fluid tight seal therebetween to prevent the undesired escape of the contents of jerry can 203 into the atmosphere.

Main collar member 207 is inwardly flanged at 212 so as to define cylindrical void 213, where flame arrester assembly 214 is seated. Pour spout 215 serves as an abuttment to limit axially outward movement of flame arrester 214.

Pour spout 215 is operably disposed within main collar member 207. Swival ring 216 is threadedly received by upper internal threads 210 of collar member 207 and maintains retainer 217 within notch 218 in pour spout 215. Pour spout 215 can freely rotate 360 degrees and can therefore be aligned in the desired pour position. Seal 219 prevents fluids or vapors within jerry can 201 from escaping into the atmosphere when pour spout 115 is closed.

Pour spout 215 extends angularly above swival ring 116. In this embodiment, the pour spout front portion 220 is shorter than pour spout rear portion 221. The pour spout 215 is shown in FIG. 15 as having a spout angle of approximately 70 degrees with respect to a common horizontal plane. The downwardly angled edge 215c of pour spout 215 effectively limits the distance traveled of spewing vapors and fuel escaping from jerry can 101.

This embodiment further shows safety cap 222 inclined and seated at a downward angle of approximately 100 degrees with respect to the longitudinal axis of pour spout 215 when in the closed position, as a result of pour spout front portion 220 being vertically shorter than pour spout rear portion 221.

As shown in FIG. 15, the downward angle of approximately 100 degrees of the safety cap member 222 with respect to the longitudinal axis of pour spout 215 is accomplished by either offsetting outer pour spout portion 215*b* angularly downward with respect to inner pour spout portion 215*a* or angularly slicing the outer pour spout portion 215*b* of pour spout 215 so that pour spout front portion 220 is sufficiently below spout rear portion 221 as to cause safety cap 222 to rest upon pour spout 215 at the desired angle, when in the closed position. While this particular configuration has been shown to achieve the desired results of limiting the distance of travel of spewing vapors or fuel, such other configurations of spout angle and safety cap member angle with respect to the pour spout that achieve the above-mentioned results should also be considered as being within the scope of the invention.

Figure 16:
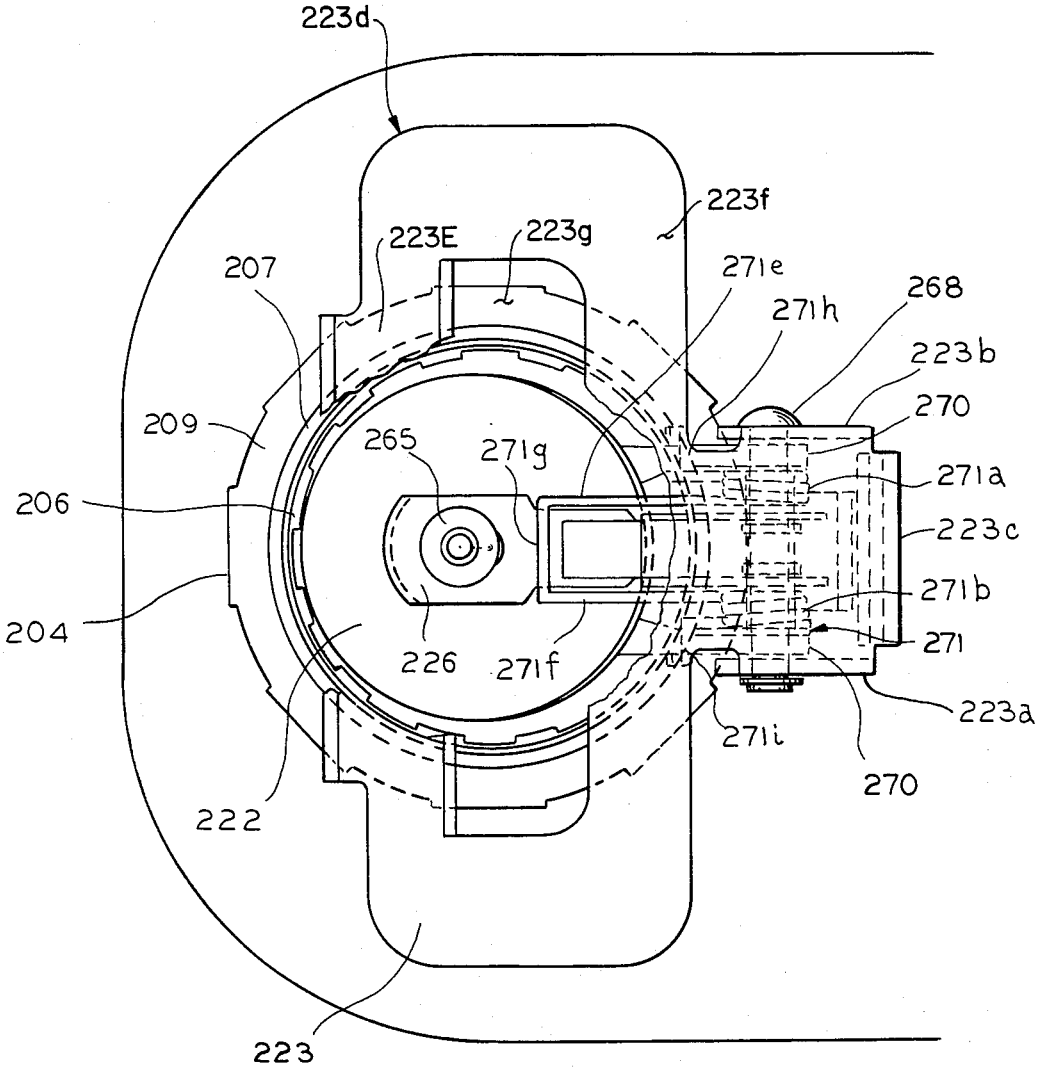
FIG. 16 is a top plan view of the modified adapter arrangement of FIG. 15.

As illustrated in FIG. 16, a handle assembly 223 is provided, pivotally mounted to flanges 270 rigidly secured to tne outer surface of pour spout 215. The handle assembly is provided with side brackets 223*a* and 223*b* having slot or opening 268*a* formed therein so as to receive pivot pin 268 passing through pour spout flanges 270. An L-shaped cover bracket 226 is connected to pin bracket 265 which is in turn affixed to safety cap 222. Thus, handle assembly 223 and cover bracket 226 are pivotally mounted about a common axis, namely, the axis of pin 268.

The grip portion 223*d* of assembly 223, as seen in FIGS. 15 and 16 is a plate consisting of two substantially flat surfaces, 223*e* and 223*f*. Further, grip slot 223*g* is provided in handle assembly 223 so as to facilitate grabbing handle 223 and rotating it clockwise as viewed in FIG. 15, in order to open said pour spout.

Safety cover 222 is constantly biased towards the closed position by coil spring 271. Coil spring 271 includes two coil sections 271*a* and 271*b*, respectively, which are wound about pivot pin 268, about which handle 223 and cover bracket 266 are pivotally mounted. Ends 271*i* and 271*h* of coil 271 are anchored beneath flanges 270 of pour spout 215. One end of spring coil section 271*a*, indicated at 271*e*, is brought out and connected to one end of coil spring section 271*b*, as indicated at 271*f*, with the ends of the two coil springs 271*a* and 271*b* being connected by portion 271*g*. The connected spring portions 271*e*, 271*f* and 271*g* together define a U-shaped spring member which bears against the outer surface of L-shaped cover bracket 266 to constantly urge safety cap 222 toward a closed position.

As handle 223 is swung clockwise about pivot pin 268 to the standard pouring position (shown in phantom line at 223' in FIG. 15) extension 223*c* of handle 223 impinges upon rear face 226*a* of cover bracket 226 and in turn, causes cover bracket 226 to pivot about pin 268 thereby pulling up on pin bracket 265 and causing safety cover 222 to unseat from said open pour spout 215.

As shown in FIG. 15, as a result of the separation between handle extension 223*c* and face 226*a* an interval of clockwise rotation of handle 223 is provided before edge 223*c* contacts back face 226*a* of cover bracket 226 to begin unseating safety cap 222 from pour spout 215.

Conversely, safety cap 222 and bracket 226 will rotate about pin 225 in response to container internal pressure sufficient to overcome the spring biasing force exerted by spring 271. Separation between bracket 226 and handle 223 allows for some venting of the container interior prior to bracket 226 contacting and moving handle 223.

Further, as previously described, spring 271 serves to bias cover bracket 226 and ultimately, safety cap 222 into a closed and seated position. Consequently, the force applied to handle 223 to achieve clockwise rotation, must be of sufficient magnitude to defeat the biasing spring force. Conversely, spring 271 will cause cover bracket 226 to rotate counter-clockwise, causing back face 226*a* to impinge upon handle edge 223*c* and thereby result in handle 223, cover bracket 226 and safety cap 222 rotating to a closed position.

In addition, when handle 223 is swung clockwise to the standard pouring position (shown in phantom line at 223' in FIG. 15), edge 223*c* of handle 223 strikes up against flange portion 209 of collar 207 so as to define a stop point for opening movement of handle 223.

In the event of excessive pressures within the interior of container 250, necessitating venting of the contents to avoid explosion, safety cap 222 is capable of becoming unseated from pour spout 215 to allow venting, when the interior pressures are great enough to overcome the biasing force exerted by spring 271.

However, even in the event that container 250 is in stacked relation to other containers, such as container 250' shown in FIG. 15, the low profile design of handle 223 provides for clearance between it and the lower recessed portion 250'*a* of container 250'. Consequently, venting is provided as excessive interior pressures cause safety 222, cover bracket 226 and in turn, handle 223 to rotate about pin 268, until the travel of handle 223 is restricted by contact with lower recessed portion 250'*a* of container 250'.

The radial distance from pin bracket 265 and pivot pin 225 defines an arc of rotation for safety cap 222 and bracket 226 about pin 225, that enables some automatic venting of tne container interior without handle 223 contacting container 250' stacked above it.

From the foregoing detailed description of the invention, it has been shown how the objects of the present invention have been obtained in a preferred manner. However, modifications and equivalents of the disclosed concepts such as readily occur to those skilled in the art are intended to be included within the scope of the invention.

What is claimed is:

1. In combination with a safety container for storing volatile inflammable fluid having an opening, a top surface, and a bottom surface, with a pour spout having a first and a second end secured within said opening, and a flame arrestor assembly operably affixed to the pour spout at the second end and suspended within the opening in the container, said combination further including a spring biased safety cap pivotally joined by means of connecting link means to a pivot support means, such that the safety cap may pivot between at least a first position wherein the safety cap is engaged with the pour spout to substantially seal the opening in the container, and a second position wherein the safety cap is substantially disengaged from the pour spout, said link means pivotally connected to said pivot support means by a pivot pin, the combination further including an operating handle also pivotally attached to the pivot support means by said pivot pin, and means cooperating with said operating handle and said link means for causing said link means and said safety cap to pivot between at least said first and second positions in response to pivotal movement of said operating handle about said pivot pin, the improvement comprising:

said cooperating means associated with said link means and said operating handle including a pin member passing through said link means and said handle means;

said link means having a first and a second end, and being operably attached to said safety cap at said first end;

said pivot pin passing through said link means at said second end to provide said pivotal movement of said safety cap between said first and second positions in response to rotation of said operating handle;

said operating handle having a slot therein cooperating with said pin member through which said pin member passes;

said slot guiding movement of said pin member in response to pivotal movement of said safety cap and said link means responsive to excessive pressure applied to said safety cap by the contents of said container when said safety cap is in said first closed position, to allow said safety cap to disengage from said pour spout and permit venting of said container interior without movement of said operating handle;

said slot having a front and a back end; and said pin member travelling along said slot towards said front end in response to pivotal movement of said link means when said link means is displaced for said venting.

2. The invention according to claim 1 wherein said slot further guides movement of said pin member in response to rotation of said operating handle so as to allow an interval of lost motion in connection with rotation of said operating handle, during which interval said safety cap remains in said first closed position; and said pin member travelling along said slot towards said back end in response to such pivotal movement of said operating handle, thereby allowing said rotation of said handle without venting of said container interior.

3. The invention according to claim 1 wherein said first end of said pour spout is offset angularly downward with respect to said second end of said spout, limiting the travel distance of spewing liquids and vapors during said venting.

* * * * *